United States Patent [19]

Parker et al.

[11] Patent Number: 4,761,672

[45] Date of Patent: Aug. 2, 1988

[54] RAMPED DEVELOPER BIASES

[75] Inventors: Delmer G. Parker; Jerome E. May, both of Rochester; William M. Allen, Jr., Webster, all of N.Y.

[73] Assignee: Xerox Corporation, Stamford, Conn.

[21] Appl. No.: 78,750

[22] Filed: Jul. 28, 1987

[51] Int. Cl.[4] ..... G03G 15/08

[52] U.S. Cl. ..... 355/14 D; 355/3 DD; 430/35; 430/42

[58] Field of Search ..... 355/14 D, 3 DD, 3 R, 355/14 R, 3 CH, 14 CH; 430/42, 35, 122; 118/647, 651

[56] References Cited

U.S. PATENT DOCUMENTS

| | | | |
|---|---|---|---|
| 2,297,691 | 10/1942 | Carlson | 95/5 |
| 2,576,047 | 11/1951 | Schaffert | 101/426 |
| 2,647,464 | 8/1953 | Ebert | 101/426 |
| 2,825,814 | 3/1958 | Walkup | 250/49.5 |
| 3,013,890 | 12/1961 | Bixby | 117/17.5 |
| 3,045,644 | 7/1962 | Schwertz | 118/637 |
| 3,816,115 | 6/1974 | Gundlach et al. | 96/1.4 |
| 3,832,170 | 8/1974 | Nagamatsu et al. | 96/1.2 |
| 3,838,919 | 10/1974 | Takahashi | 355/4 |
| 4,032,227 | 6/1977 | Hubbard et al. | 355/14 |
| 4,068,938 | 1/1978 | Robertson | 355/4 |
| 4,078,929 | 3/1978 | Gundlach | 96/1.2 |
| 4,337,306 | 6/1982 | Kanbe et al. | 430/122 |
| 4,346,982 | 8/1982 | Nakajima et al. | 355/3 |
| 4,403,848 | 9/1983 | Snelling | 355/4 |
| 4,562,129 | 12/1985 | Tanaka et al. | 430/42 |
| 4,562,130 | 12/1985 | Oka | 430/54 |
| 4,714,942 | 12/1987 | Nakanishi | 355/14 R |

OTHER PUBLICATIONS

U.S. Serial No. (D/86207) Copending Application, Developer Apparatus, Jerome E. May.

*Primary Examiner*—A. C. Prescott

[57] ABSTRACT

Undesirable transient development conditions that occur during start-up and shut-down in a tri-level xerographic systemw when the developer biases are either actuated or de-actuated are obviated by using a control strategy that relies on the exposure system to generate a spatial voltage ramp on the photoreceptor during machine start-up and shut-down. Furthermore, the development systems' bias supplies are programmed so that their bias voltages follow the photoreceptor voltage ramp at some predetermined offset voltage. This offset is chosen so that the cleaning field between any development roll and the photoreceptor is always within reasonable limits. As an alternative to synchronizing the exposure and developing characteristics, the charging of the photoreceptor can be varied in accordance with the change of developer bias voltage.

24 Claims, 3 Drawing Sheets

RAMPED DEVELOPER BIASES

BACKGROUND OF THE INVENTION

This invention relates generally to the rendering of latent electrostatic images visible using multiple colors of dry toner or developer and more particularly to a developer apparatus for forming toner images in black and at least one highlighting color in a single pass of the imaging surface through the processing areas of a printing apparatus.

The invention can be utilized in the art of xerography or in the printing arts. In the practice of xerography, it is the general procedure to form an electrostatic latent image on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed.

This method of forming and developing charge patterns is set forth in greater detail in U.S. Pat. No. 2,297,691 to C. F. Carlson. Still other means of forming and developing electrostatic images are set forth in U.S. Pat. No. 2,647,464 to J. P. Ebert; U.S. Pat. No. 2,576,047 to R. M. Schaffert and U.S. Pat. No. 2,825,814 to L. E. Walkup.

Modern business and computer needs oftentimes make it advantageous and desirable to reproduce originals which contain two or more colors. It is sometimes desirable that a copy or reproduction also contain two colors.

An accounting report having certain information highlighted in a second color is one example of a type of document which would desirably be copied in more than one color. Computer generated cathode ray tube (CRT) displays are another example in which it is sometimes desirable to reproduce an image in more than one color. For instance, it is sometimes desirable that those portions of the CRT display image representing permanent forms are reproduced in a first color and those portions of the image representing variable information are reproduced in a second color.

Several useful methods are known for making copies having plural colors. Some of these methods make high quality images, however, there is still need for improvement. In particular, it is desirable to be able to produce low-smear images in a single pass of the photoreceptor or other charge retentive surface past the printing process areas or stations.

One method of producing images in plural (i.e. two colors, black and one highlight color) is disclosed in U.S. Pat. No. 3,013,890 to W. E. Bixby in which a charge pattern of either a positive or negative polarity is developed by a single, two-colored developer. The developer of Bixby comprises a single carrier which supports both triboelectrically relatively positive and relatively negative toner. The positive toner is a first color and the negative toner is of a second color. The method of Bixby develops positively charged image areas with the negative toner and develops negatively charged image areas with the positive toner. A two-color image occurs only when the charge pattern includes both positive and negative polarities.

Plural color development of charge patterns can be created by the Tesi technique. This is disclosed by F. A. Schwertz in U.S. Pat. No. 3,045,644. Like Bixby, Schwertz develops charge patterns which are of both a positive and negative polarity. Schwertz's development system is a set of magnetic brushes, one of which applies relatively positive toner of a first color to the negatively charged areas of the charge pattern and the other of which applies relatively negative toner to the positively charged areas.

Methods and apparatus for making colored xerographic images using colored filters and multiple development and transfer steps are disclosed, respectively, in U.S. Pat. Nos. 3,832,170 to K. Nagamatsu et al and 3,838,919 to T. Takahashi.

U.S. Pat. No. 3,816,115 to R. W. Gundlach and L. F. Bean discloses a method for forming a charge pattern having charged areas of a higher and lower strength of the same polarity. The charge pattern is produced by repetitively charging and imagewise exposing an overcoated xerographic plate to form a composite charge pattern. Development of the charge pattern in one color is disclosed.

A method of two-color development of a charge pattern, preferably with a liquid developer, is disclosed in the commonly assigned U.S. Pat. No. 4,068,938 issued on Jan. 17, 1978. This method requires that the charge pattern for attracting a developer of one color be above a first threshold voltage and that the charge pattern for attracting the developer of the second color be below a second threshold voltage. The second threshold voltage is below the first threshold voltage. Both the first and second charge patterns have a higher voltage than does the background.

As disclosed in U.S. Pat. No. 4,403,848 a multi-color printer uses an additive color process to provide either partial or full color copies. Multiple scanning beams, each modulated in accordance with distinct color image signals, are scanned across the printer's photoreceptor at relatively widely separated points, there being buffer means provided to control timing of the different color image signals to assure registration of the color images with one another. Each color image is developed prior to scanning of the photoreceptor by the next succeeding beam. Following developing of the last color image, the composite color image is transferred to a copy sheet. In an alternate embodiment, an input section for scanning color originals is provided. The color image signals output by the input section may then be used by the printing section to make full color copies of the original.

In U.S. Pat. No. 4,562,129 there is disclosed an image forming method comprising the steps of forming a latent electrostatic image having at least three different potential levels on a photosensitive member, and developing the latent electrostatic image with a developer to obtain a monochromatic or dichromatic copy image, the developer being composed of at least two components of a non-magnetic insulating toner and a high-resistivity magnetic carrier triboelectrically chargeable with the toner and having a high resistivity of at least $10^{12}$ ohm-cm, the carrier being in the form of particles about 5 to about 40 microns in size, prepared by dispersing a magnetic fine powder in an insulating resin and containing the magnetic fine powder in a proportion of 50 to 75% by weight.

U.S. Pat. No. 4,562,130 relates to a composite image forming method having the following features: (A) Forming a composite latent electrostatic image of potentials at three different levels by two image exposures, the potential of the background area (nonimage area) resulting from the first image exposure is corrected to a stable intermediate potential which is constant at all times by charging the area with scorotron charging means. Accordingly the image can be developed to a satisfactory copy image free from fog. (B) The composite latent electrostatic image is developed by a single developing device collectively, or by two developing devices. In the latter case, the composite latent image is not developed after it has been formed, but the latent image resulting from the first exposure is developed first before the second exposure, and the latent image resulting from the second exposure is thereafter developed, whereby the fog due to an edging effect is prevented whereby there is produced a satisfactory copy image.

In U.S. Pat. No. 4,346,982, there is disclosed an electrophotographic recording device having means for uniformly charging the surface of a light-sensitive recording medium, means for forming latent images on said light-sensitive recording medium and means for developing said latent images into visual images, said electrophotographic recording device being characterized in that said means for forming latent images on said light-sensitive recording medium comprises a plurality of exposing means for exposing a positive optical image and a negative optical image in such a manner that the light receiving region of said negative optical image overlaps the light receiving region of said positive optical image, whereby a latent image is formed on the surface of said light-sensitive recording medium consisting of a first area which does not receive any light of said negative or positive image and holds an original potential, a second area which receives the light of only said positive image and holds a reduced potential from that of said original potential and a third area which receives the light of both of said negative image and said positive image and holds a further reduced potential than said reduced potential of said second area.

In U.S. Pat. No. 4,078,929, R. Gundlach teaches the use of trilevel xerography as a means to achieve single-pass highlight color copy. In this scheme the photoreceptor, initially charged to voltage $V_0$, is discharged to approximately $V_0/2$ imagewise in the background (white) image areas, and to near zero or residual potential in the highlight color (color other than black) portions of the image. The unexposed portions of the photoreceptor now correspond to the parts of the image that are to be printed black. It should be noted that whether the charged area is developed black or color in practice depends on the choice of developer polarity as described below.

The charge pattern in the '929 patent is developed with toner particles of first and second color. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

FIG. 1*a* illustrates the tri-level electrostatic latent image in more detail. Here $V_0$ is the initial charge level, $V_{ddp}$ the dark discharge potential (unexposed), $V_{white}$ the white discharge level and $V_c$ the photoreceptor residual potential (full exposure).

Color discrimination in the development of the electrostatic latent image is achieved by passing the photoreceptor through two developer housings in tandem which housings are electrically biased to voltages which are offset from the background voltage $V_{white}$, the direction of offset depending on the polarity or sign of toner in the housing. One housing (for the sake of illustration, the first) contains developer with black toner having triboelectric properties such that the toner is driven to the most highly charged ($V_{ddp}$) areas of the latent image by the electric field between the photoreceptor and the development rolls biased at $V_{bb}$ (V black bias) as shown in FIG. 1*b*. Conversely, the triboelectric charge on the colored toner in the second housing is chosen so that the toner is urged towards parts of the latent image at residual potential by the electric field existing between the photoreceptor and the development rolls in the second housing at bias voltage $V_{cb}$ (V color bias).

Because the composite image developed on the photoreceptor consists of both positive and negative toner, a pre-transfer corona charging step is necessary to condition the toner to enable effective transfer to a substrate using corona discharge.

The photoreceptor potential corresponding to white (background) in a tri-level xerography scheme is $\approx 500$ volts. During the machine cycle-up, the photoreceptor must make the transition from its discharged (0 potential) state to the normal quiescent white level at $\approx 500$ volts. This transition is basically a step function and, if it arrives at the first development station before the development housing bias is turned on, one of two undesirable things can happen. Which one occurs depends upon whetherthe first development station is operating as a Charged Area Development (CAD) system or a Discharged Area Development (DAD) system.

In the case of CAD, background or white level potential will look like an image to the unbiased developer. This spurious image can be very large during start-up and, as a result, can drain large amounts of toner out of the housing, contribute to machine dirt, overload the cleaning system, and add to the bead carryout problem.

If, on the other hand, the bias is applied to the CAD development housing while the photoreceptor is still in the discharged state, a very high reverse development (cleaning) field is created which puts a high electrical stress on the developer. Typically, this reverse development field is on the order of 600 volts. Under this kind of stress, conductive developers can generate wrong sign toner which will be deposited in the background regions of the photoreceptor and can cause bead carryout. (Note that the toner cleaning field is a bead development field.)

A similar set of undesirable development conditions occur for cycle-down.

The entire situation is reversed if the first development housing is operating in the DAD mode. Here, if the housing bias is applied too early (while the photoreceptor is still in a discharged state), the photoreceptor looks like an extended solid area image. This spurious image can be very large during start-up and, as a result, can drain large amounts of toner out of the housing, contribute to machine dirt, overload the cleaning system, and add to the bead carryout problem. Conversely, the absence of bias when the charged photoreceptor arrives can produce wrong sign toner and enhances the bead carryout problem.

Precise timing of when the developer bias is applied or removed can alleviate the development transient conditions described here if the development system uses only a single roll. However, whenever multiple development roll systems are employed, abnormal development conditions will always prevail at one or more of the rolls during machine start-up or shut-down. Hence, the development system(s) will be subjected to development transients that produce unacceptable side effects.

One way of obviating the aforementioned undesirable transient development even though the developer biases are fully applied, as disclosed in co-pending application Ser. No. 78,743 filed July 28, 1987 assigned to the same assignee as the instant application, is to prevent contact of the developer with the photoreceptor until a predetermined voltage level on the photoreceptor is reached. Such a technique functions independent of whether images are present on the photoreceptor, the sole criterion for allowing contact being whether the photoreceptor has reached the predetermined voltage level.

In U.S. Pat. No. 4,032,227, it is noted (column 6, lines 6–13) that in certain types of apparatus developer mix is physically presented to a photoconductor only when the photoconductor's area then passing through the developer includes a latent image.

BRIEF SUMMARY OF THE INVENTION

The aforementioned undesirable transient development conditions that occur during start-up and shut-down in a tri-level xerographic system when the developer biases are either fully actuated or fully de-actuated are overcome in the present invention by using a control strategy that relies on the exposure system to generate a spatial voltage ramp on the photoreceptor during machine start-up (cycle-up) and shut-down (cycle-down). Furthermore, the development systems' bias supplies are programmed so that their bias voltages follow the photoreceptor voltage ramp at some predetermined offset voltage. This offset is chosen so that the cleaning field between each development roll and the photoreceptor is always within reasonable limits.

In the case of an electronic printer, generation of the spatial voltage or potential ramp is accomplished by turning the charging and exposure devices on to full output. Then the output of the exposure device (for example, a laser Raster Output Scanner (ROS), which initially discharges the photoreceptor to a predetermined voltage level) can be modified by means of a stored program or set of values in a controller, yielding a gradually increasing potential on the photoreceptor.

In the case of a non-electronic apparatus, the change in photoreceptor potential during the start-up transition can be accomplished by means of a stored program or set of increasing values in fixed memory of the controller, being sent to a digital-to-analog converter, and thence to the programmable power supply driving the charging device.

In the case of either the electronic or non-electronic apparatus, an appropriate stored program or set of increasing values in fixed memory of the controller for the developer housing, applied through a digital-to-analog converter and a programmable power supply, will cause the developer roll potentials to track the photoreceptor potential upward as the appropriately charged area of the photoreceptor goes past the developer rolls, keeping the difference between photoreceptor and developer roll potentials at a predetermined minimum.

The inverse operations are affected during shut-down.

In the case of an electronic printer, the charging device is kept turned on to full output and the exposure device is increased to full value by means of a stored program or set of increasing values in the controller, giving a gradually decreasing potential on the photoreceptor.

In the case of a non-electronic imaging apparatus, the output of the charging device can be gradually reduced from full output to zero by means of a stored program or set of decreasing values in fixed memory of the controller, being sent to a digital-to-analog converter, and thence to the programmable power supply driving the charging device.

In either case, an appropriate stored program or set of decreasing values in fixed memory of the controller for the developer housing, through the digital-to-analog converter and programmable power supply, will cause the developer roll potential to track the photoreceptor potential downward as the appropriately charged area of the photoreceptor goes past the developer rolls, keeping the difference between photoreceptor and developer roll potentials at a predetermined minimum value.

DETAILED DESCRIPTION OF THE PREFERRED EMBODIMENT OF THE INVENTION

Figure 2:
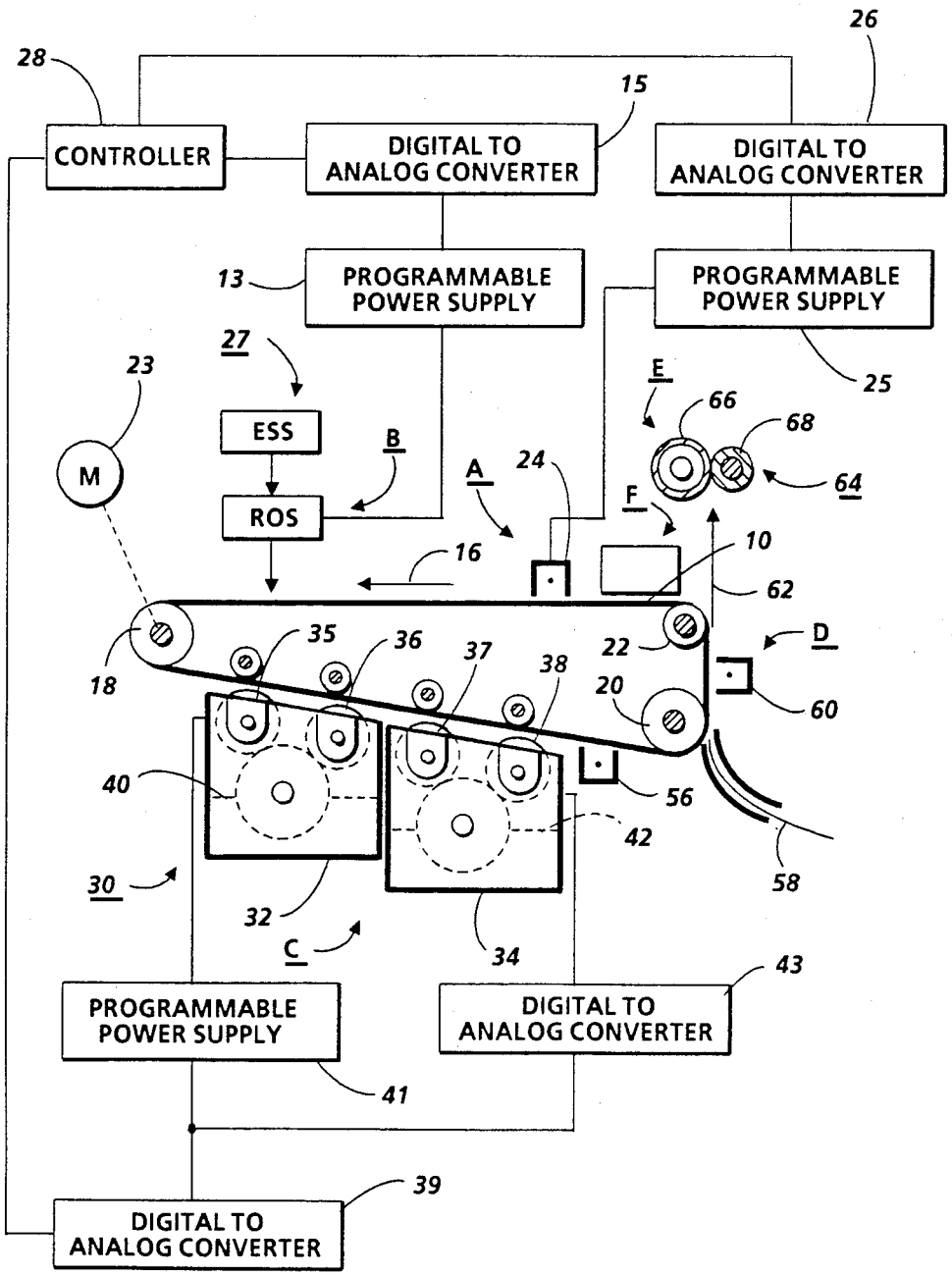
FIG. 2 is schematic illustration of a printing apparatus incorporating the inventive features of our invention.

As shown in FIG. 2, the printing machine utilizes a photoconductive belt 10 which consists of a photoconductive surface and an electrically conductive substrate mounted for movement past a charging station A, an exposure B, developer stations C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially a portion of belt 10 passes through charging station A. At charging station A, a corona discharge device such as a scorotron, corotron or dicorotron indicated generally by the reference numeral 24, charges the belt 10 to a selectively high uniform positive or negative potential, $V_0$. Preferably charging is negative. While any suitable control, well known in the art, may be employed, the corona discharge device 24 is controlled by a programmable power supply 25, digital to analog converter 26 and a controller 27. Thus, the output from the corona discharge device 24 can be varied in accordance with the electrical biasing of the developer rolls disposed at the developer station C. It will be appreciated that the corona discharge device can controlled independently of the developer bias.

Next, the charged portion of the photoreceptor surface is advanced through exposure station B. At exposure station B, the uniformly charged photoreceptor or charge retentive surface 10 is exposed to a laser based input and/or output scanning device 27 which causes the charge retentive surface to be discharged in accordance with the output from the scanning device. Preferably the scanning device is a three level laser Raster Output Scanner (ROS). The ROS 27 output is set via a programmable power supply 13 which is driven by means of a controller 28 via a digital to analog converter 15. Alternatively, the ROS could be replaced by a conventional xerographic exposure device.

The photoreceptor, which is initially charged to a voltage $V_0$, undergoes dark decay to a level $V_{ddp}$. When exposed at the exposure station B it is discharged to $V_{white}$ imagewise in the background (white) image areas and to $V_c$ which is near zero or ground potential in the highlight (i.e. color other than black) color parts of the image. See FIG. 1*a*.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers 38 advances its respective developer material into contact with the latent image. Each developer roller pair forms a brush-like structure comprising toner particles which are attracted therefrom by the latent electrostatic images on the photoreceptor. The roll pair 35, 36 is electrically biased by means of a programmable power supply 41, digital to analog converter 39 and the controller 27. The roll pair 37, 38 is electrically biased by means of a programmable power supply 43, the digital to analog converter 39 and the controller 27.

During cycle-up, in the case of either the electronic or non-electronic apparatus, an appropriate stored program or set of increasing values in fixed memory of the controller for the developer housing, applied through a digital-to-analog converter and a programmable power supply, will cause the developer roll potentials to track the photoreceptor potential upward as the appropriately charged area of the photoreceptor goes past the developer rolls, keeping the difference between photoreceptor and developer roll potentials at a predetermined minimum.

During cycle-down, in the case of either the electronic or non-electronic apparatus, an appropriate stored program or set of decreasing values in fixed memory of the controller for the developer housing, through the digital-to-analog converter and programmable power supply, will cause the developer roll potential to track the photoreceptor potential downward as the appropriately charged area of the photoreceptor goes past the developer rolls, keeping the difference between photoreceptor and developer roll potentials at a predetermined minimum value.

Color discrimination in the development of the electrostatic latent image is achieved by passing the photoreceptor past the two developer housings in a single pass with the magnetic brush rolls electrically biased to voltages which are offset from the background voltage $V_{white}$, the direction of offset depending on the polarity of toner in the housing. One housing e.g. 32 (for the sake of illustration, the first) contains developer with black toner 40 having triboelectric properties such that the toner is driven to the most highly charged ($V_{ddp}$) areas of the latent image by the electrostatic field (development field) between the photoreceptor and the development rolls biased at $V_{bb}$ as shown in FIG. 1*b*. Conversely, the triboelectric charge on colored toner 42 in the second housing is chosen so that the toner is urged towards parts of the latent image at residual potential, $V_c$ by the electrostatic field (development field) existing between the photoreceptor and the development rolls in the second housing at bias voltages $V_{cb}$.

Figure 1A:
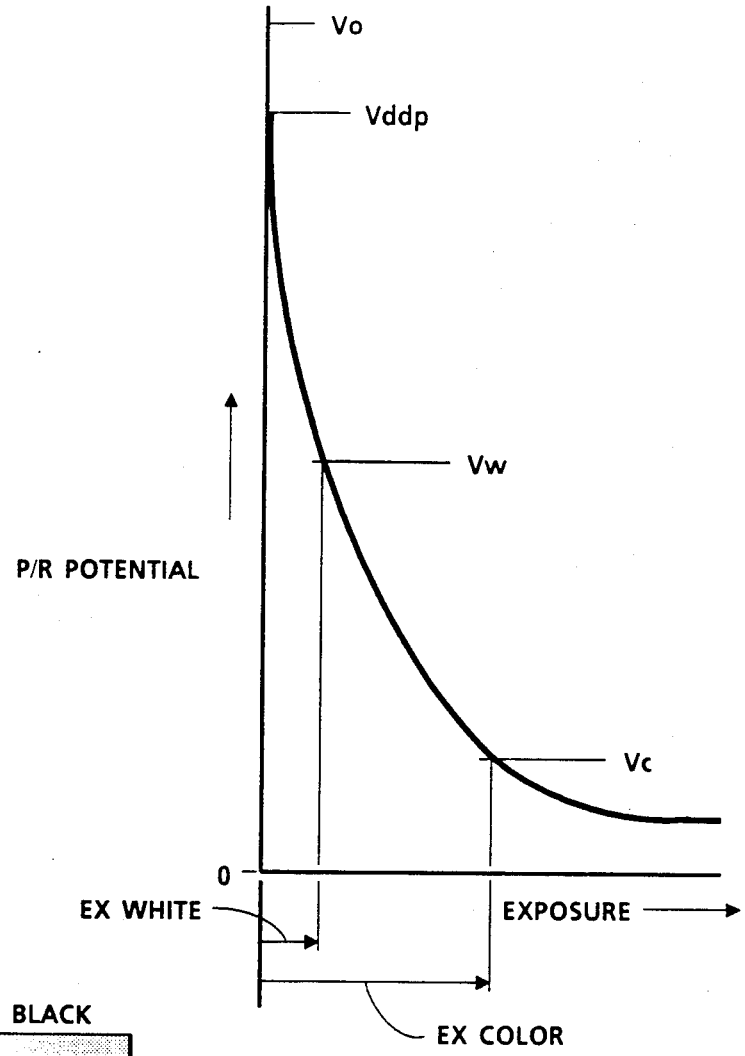
FIG. 1*a* is a plot of photoreceptor potential versus exposure illustrating a tri-level electrostatic latent image.
Figure 1B:
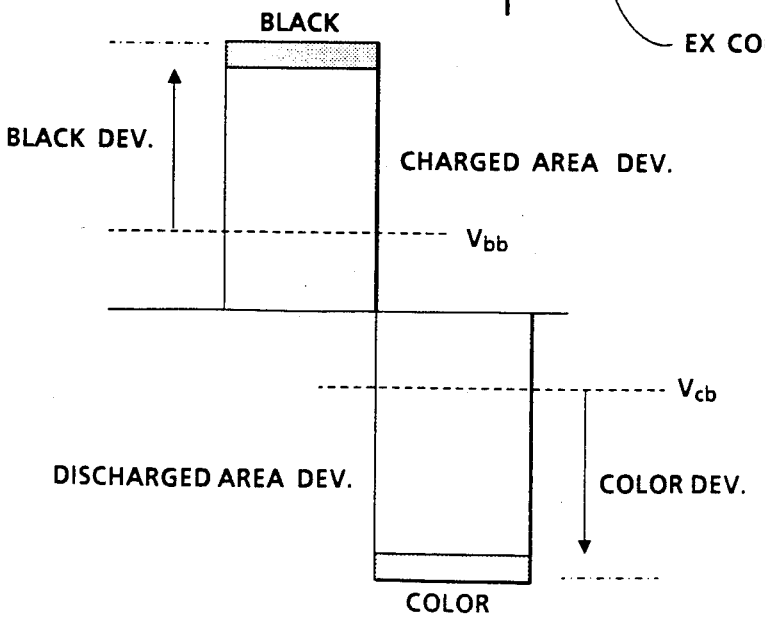
FIG. 1*b* is a plot of photoreceptor potential illustrating single-pass, highlight color latent image characteristics.

In prior art tri-level xerography, the entire photoreceptor voltage difference ($|V_{ddp}-V_c|$, as shown in FIG. 1*a*) is shared equally between the charged area development (CAD) and the discharged area development (DAD). This corresponds to $\approx$800 volts (if a realistic photoreceptor value for $V_{ddp}$ of 900 volts and a residual discharge voltage of 100 volts are assumed). Allowing an additional 100 volts for the cleaning field in each development housing ($|V_{bb}-V_{white}|$ or $|V_{white}-V_{cb}|$) means an actual development contrast voltage for CAD of $\approx$300 volts and an equal amount for DAD. In the foregoing case the 300 volts of contrast voltage is provided by electrically biasing the first developer housing to a voltage level of approximately 600 volts and the second developer housing to a voltage level of 400 volts.

A sheet of support material 58 is moved into contact with the toner image at transfer station D. The sheet of support material is advanced to transfer station D by conventional sheet feeding apparatus, not shown. Preferably, sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a pre-transfer corona discharge member 56 is provided to condition the toner for effective transfer to a substrate using corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F.

Subsequent to cleaning, a discharge lamp (not shown) floods the photoconductive surface with light to dissipate any residual electrostatic charge remaining prior to the charging thereof for the successive imaging cycle.

Figure 3:
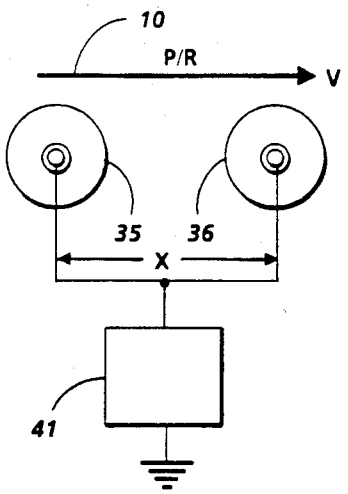
FIG. 3 is a fragmentary schematic view of a two-roll development system including a programmable power supply for biasing thereof.

FIG. 3 depicts one of the developer systems where the two rolls 35 and 36 are spaced apart a distance "x"; the photoreceptor is moving at a velocity "v"; and where the power supply 41 supplies the bias for both rolls. For the purpose of this discussion it is assumed this development housing is operating in the charged area development (CAD) mode, and that we wish to maintain a cleaning field between the photoreceptor and the development rolls of at least 50 volts, and never more than 200 volts, throughout cycle-up/cycle-down.

Figure 4:
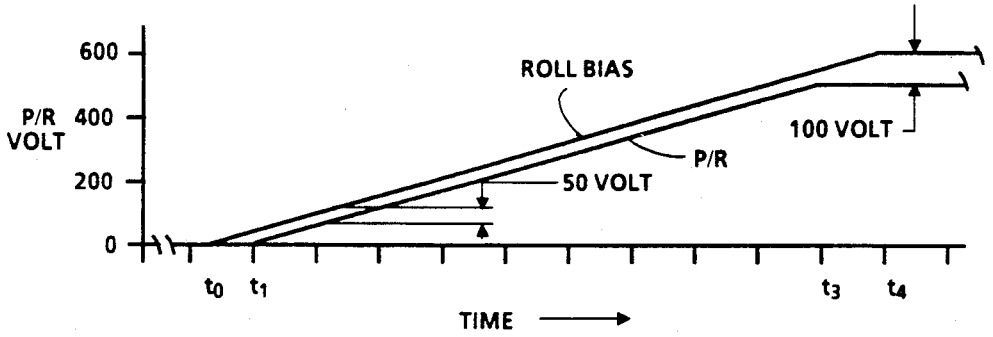
FIG. 4 is a plot of photoreceptor and developer roll bias versus time for the first of two rolls of the developer system of FIG. 3.
Figure 5:
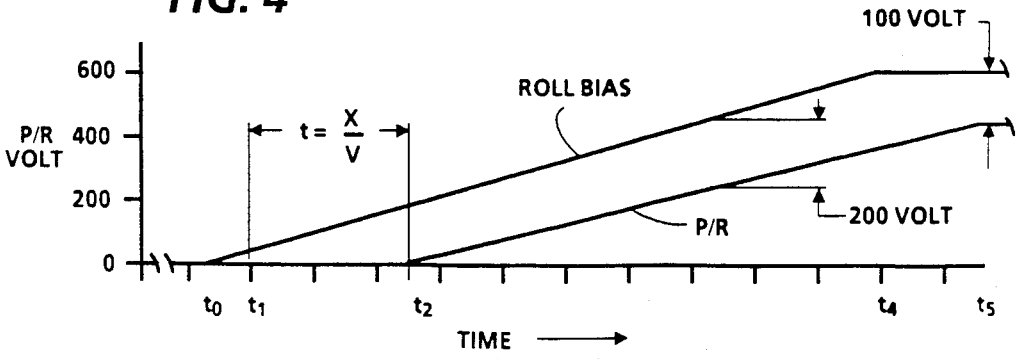
FIG. 5 is a plot of photoreceptor and developer roll bias versus time for the other of the two rolls of the developer system of FIG. 3.

At the beginning of the machine start-up cycle, the exposure level is operated at a level to insure the photoreceptor is fully discharged regardless of the initial photoreceptor voltage. Later, when it is certain that the photoreceptor is being fully charged, the exposure is gradually reduced in a controlled way so that the photoreceptor potential increases from residual to the quiescent background voltage according to a predetermined spatial gradient (ramp). At a time $t=t_0$, just before the photoreceptor voltage ramp reaches developer roll 35, the bias to rolls 35 and 36 is switched on and ramped at the same slope as the ramp on the photoreceptor (see FIG. 4). Bias voltage start-up time, $t_0$, is chosen so that, at time $t_1$, as the lead edge of the photoreceptor voltage ramp passes roll 35, the instantaneous value of the bias voltage (on both) is 50 volts above the photoreceptor residual voltage. The lead edge of the photoreceptor reaches roll 36 at time $t_2$ (see FIG. 5). The ramp rates selected are such that the bias on the two rolls will make roll 36's potential, at the instant the photoreceptor ramp lead edge passes ($t=t_2$), 200 volts above photoreceptor residual.

The photoreceptor above roll 35 will continue to increase in potential until it reaches its operating background potential (taken here as 500 v) at time $t=t_3$. This occurs above roll 36 at time $t=t_5$. Both rolls reach their operating bias (taken here as 600 volts) at time $t=t_4$.

The slope of the voltage ramps in this example can be calculated as follows. Assume $x=10$ cm, and $v=20$ cm/sec. Note that at time $t=t_1$, the instantaneous photoreceptor voltage above roll 35 is equal to residual potential (taken here as 0). At time $t_2$, the photoreceptor potential above roll 35 is 50 volts less than the bias voltage (which is 200 volts above residual in order to satisfy conditions at roll 36). Hence, the change in photoreceptor potential is 150 volts between roll 35 and roll 36. The slope of the voltage ramp on the photoreceptor (and the bias voltage as well) is 150 volts/(roll spacing). In the example case, the spatial gradient voltage on the photoreceptor is 150 volts/10 cm=15 volts/cm and the rate of change is 15 volts/cm×20 cm/sec=300 volts/sec. Using this, the time that the bias voltage is applied can be found by: $t=t_1-[50$ volts/(3OO v/sec)$=t_1-0.167$ sec]. Thus, the bias ramp starts 167 ms before the photoreceptor voltage ramp reaches roll 35. The whole transition from "off" to "normal" operation in this case takes about 2 seconds [600 v/(300 v/sec)].

In machine cycle-down, the whole process is reversed. The bias starts ramping down when the lead edge of the photoreceptor ramp passes roll 36 and roll 36 bias tracks the photoreceptor voltage down with an offset of 50 volts while roll 35 tracks with a 200 volt offset.

For a development system operating in the Discharged Area Development (DAD) mode, the procedure is the same except that the bias voltage is always below the photoreceptor potential by 50 to 200 volts during cycle-up/cycle-down.

In a multiple (i.e. three or more rolls as opposed to the two disclosed) roller development system, the ramp gradients are determined the same way as above using 35 as the first roller and 36 as the last roller. The cleaning field for all intermediate rolls will then lie within the range of the first and last roll.

More precise cleaning field tracking can be accomplished using separate power supplies to bias each roll. Here the voltage ramp gradient is determined by the allowable voltage difference between adjacent development rolls. For example, in the illustration above, assume that we wish to keep the voltage difference between rolls to <100 volts to avoid inter-roll development fields. The slope of the voltage ramp is then 100 volts/(10 cm)=10 volts/cm or 200 volts/sec[(10 v/cm)/(20 cm/sec)].

With individual roll bias power supplies, it is also possible to use different cleaning fields for each roll.

What is claimed is:

1. A method for producing plural-color images, said method including the steps of:

moving a charge retentive member through a plurality of processing stations;

uniformly charging a charge retentive member;

actuating a light source capable of uniformly discharging said charge retentive member and selectively discharging said charge retentive member in accordance with information to be produced;

using said light source, uniformly discharging said charge retentive member to a first predetermined voltage level;

decreasing the intensity of said light source thereby allowing the charge level on said charge retentive member to increase above said predetermined level;

applying electrical biases to at least two developer housings in such a manner that predetermined voltage differences are maintained between developer rolls in said housings and said charge retentive member until a second predetermined voltage level, substantially greater than said first predetermined voltage level, on said charge retentive member has been reached, and forming latent images on said charge retentive member with said light source which are developed when they are contacted by the developer in said housings.

2. The method according to claim 1 further including the steps of:

terminating the formation of latent images;

decreasing the intensity of said light source and the biases on said developer housings in such a manner as to maintain said predetermined voltage differences between developer rolls in said housings and said charge retentive member until said biases are substantially equal to zero.

3. The method according to claim 1 wherein the steps are carried out in the order specified.

4. In the method of producing plural-color images on a charge retentive member, the steps of:

actuating a light source and a charging member which cooperate to charge said charge retentive member to a predetermined voltage level, and applying electrical biases to at least two developer housings in such a manner that predetermined voltage differences are maintained between developer rolls in said housings and said charge retentive member until a second predetermined voltage level, substantially greater than said first predetermined voltage level, on said charge retentive member has been reached.

5. In the method of producing plural-color images on a charge retentive member, the steps of:

conditioning a portion of said charge retentive member to a predetermined voltage level;

moving said charge retentive member so that said portion moves past a first developer system, and electrically biasing said first developer system when said portion of said charge retentive member is moved opposite said first developer system in such a manner that predetermined voltage differences are established and maintained between developer rolls in said housing and said charge retentive member.

6. The method according to claim 5 including the step of increasing the voltage level on said successive portions of said charge retentive member above said predetermined voltage level.

7. The method according to claim 6 including the step of maintaining said voltage differences until a second predetermined voltage level on said charge retentive member has been reached.

8. The method according to claim 7 wherein the conditioning step includes the steps of actuating a light source and a charging member which cooperate to charge said charge retentive member to a predetermined voltage level.

9. The method according to claim 7 wherein the conditioning step includes:

moving a charge retentive member through a plurality of processing stations;

uniformly charging said charge retentive member;

actuating a light source capable of uniformly discharging said charge retentive member and selectively discharging said member in accordance with information to be produced.

10. The method according to claim 9 wherein the conditioning step further includes:

uniformly discharging said charge retentive member to a first predetermined voltage level;

decreasing the intensity of said light source thereby allowing the charge level on said charge retentive member to increase above said predetermined level.

11. The method according to claim 10 further including the step of passing said charge retentive member past a second developer system.

12. A method of producing plural-color images, said method including the steps of:

moving a charge retentive surface into cooperative relationship with components disposed at plurality of processing stations, said processing stations including a charging station, an exposure station and a development station;

controlling the operation of the components at two of said stations in such a manner that a predetermined voltage difference is maintained between developer rolls in said development station and said charge retentive member; and forming latent images on said charge retentive member at said exposure station which are developed when they are contacted by developer at said development station.

13. The method according to claim 12 wherein said controlling step comprises applying an increasing bias voltage to said developer rolls and simultaneously decreasing the intensity of light at said exposure station.

14. The method according to claim 12 wherein said controlling step comprises applying an increasing bias voltage to said developer rolls and simultaneously increasing the voltage applied at said charging station.

15. Apparatus for producing printed images by moving a charge retentive surface through a plurality of processing stations including charging, exposure and development stations, said apparatus comprising:

means for controlling the operation of the components at two of said stations in such a manner that a predetermined voltage difference is maintained between developer rolls in said development station and said charge retentive member, said difference being maintained through said image producing process; and means including said developer rolls at said developer station for applying toner material to latent images formed on said charge retentive surface at said exposure station.

16. Apparatus according to claim 15 further including:

means for terminating the formation of printed images; and wherein said controlling means comprises means for decreasing the intensity of a light source at said exposure station and increasing electrical biases on said developer rolls in such a manner as to maintain said predetermined voltage differences between said developer rolls in said housings and said charge retentive member until said biases are substantially equal to zero.

17. Apparatus according to claim 15 wherein said controlling means comprises means for increasing the voltage level applied to a discharge device disposed at said charging station and increasing electrical biases on said developer rolls in such a manner as to maintain said predetermined voltage differences between said developer rolls in said housings and said charge retentive member until said biases are substantially equal to zero.

18. A method for producing plural-color images, said method including the steps of:

moving a charge retentive member through a plurality of processing stations;

uniformly charging a charge retentive member;

actuating a light source capable of uniformly discharging said charge retentive member and selectively discharging said charge retentive member in accordance with information to be produced;

using said light source, uniformly discharging said charge retentive member to a first predetermined voltage level;

decreasing the intensity of said light source thereby allowing the charge level on said charge retentive member to increase above said predetermined level;

applying electrical biases to at least two developer housings in such a manner that predetermined voltage differences are maintained between developer structure in said housings and said charge retentive member until a second predetermined voltage level, substantially greater than said first predetermined voltage level, on said charge retentive member has been reached, and forming latent images on said charge retentive member with said light source which are developed when they are contacted by the developer in said housings.

19. The method according to claim 18 further including the steps of:

terminating the formation of latent images;

decreasing the intensity of said light source and the biases on said developer housings in such a manner as to maintain said predetermined voltage differences between said developer structure in said housings and said charge retentive member until said biases are substantially equal to zero.

20. The method according to claim 19 wherein the steps are carried out in the order specified.

21. In the method of producing plural-color images on a charge retentive member, the steps of:

actuating a light source and a charging member which cooperate to charge said charge retentive member to a predetermined voltage level, and applying electrical biases to at least two developer housings in such a manner that predetermined voltage differences are maintained between developer structure in said housings and said charge retentive member until a second predetermined voltage level, substantially greater than said first predetermined voltage level, on said charge retentive member has been reached.

22. Apparatus for producing printed images by moving a charge retentive surface through a plurality of processing stations including charging, exposure and development stations, said apparatus comprising:

means for controlling the operation of the components at two of said stations in such a manner that a predetermined voltage difference is maintained between developer structure and said charge retentive member, said developer structure being disposed at said development station for applying toner material to latent images formed on said charge retentive surface at said exposure station, said difference being maintained through said image producing process.

23. Apparatus according to claim 22 further including:

means for terminating the formation of printed images; and wherein said controlling means comprises means for decreasing the intensity of a light source at said exposure station and increasing electrical biases on said developer structure in such a manner as to maintain said predetermined voltage differences between developer structure and said charge retentive member until said biases are substantially equal to zero.

24. Apparatus according to claim 22 wherein said controlling means comprises means for increasing the voltage level applied to a discharge device disposed at said charging station and increasing electrical biases on said developer structure in such a manner as to maintain said predetermined voltage differences between developer structure and said charge retentive member until said biases are substantially equal to zero.

* * * * *